US006147657A

United States Patent [19]

Hildebrand et al.

[11] Patent Number: 6,147,657

[45] Date of Patent: Nov. 14, 2000

[54] CIRCULAR PHASED ARRAY ANTENNA HAVING NON-UNIFORM ANGULAR SEPARATIONS BETWEEN SUCCESSIVELY ADJACENT ELEMENTS

[75] Inventors: Robert C. Hildebrand, Indialantic; Gayle P. Martin, Merritt Island, both of Fla.

[73] Assignee: Harris Corporation, Melbourne, Fla.

[21] Appl. No.: 09/081,476

[22] Filed: May 19, 1998

[51] Int. Cl.[7] ..... H01Q 21/00

[52] U.S. Cl. ..... 343/844; 343/853

[58] Field of Search ..... 343/844, 853, 343/799, 801; 342/375; 455/562

[56] References Cited

U.S. PATENT DOCUMENTS

| | | | |
|---|---|---|---|
| 3,999,187 | 12/1976 | Johnson | 343/844 |
| 4,555,708 | 11/1985 | Waineo et al. | 343/853 |
| 5,767,814 | 6/1998 | Conroy et al. | 343/844 |

FOREIGN PATENT DOCUMENTS

| | | | |
|---|---|---|---|
| 2224409 | 5/1990 | United Kingdom | 343/844 |

*Primary Examiner*—Tan Ho

*Attorney, Agent, or Firm*—Allen, Dyer, Doppelt, Milbrath & Gilchrist, P.A.

[57] ABSTRACT

The elements of a spatially aperiodic phased array antenna have an unequally spaced circular distribution, that is effective to decorrelate angular and linear separations among elements of the array. For any radial direction passing through an element of the array, the vector distance from any point along that radial direction to any two elements of the array is unequal and uniformly distributed in phase, modulo $2\pi$. Angular separation between successively adjacent antenna elements varies in accordance with an Nth root of two, wherein N is the number of antenna elements in the array. To locate each element, a first element is placed at any arbitrary location along the circumference of the array. The angular spacing $\alpha_1$ of a second element relative to the first element is defined such that $\alpha_1=2\pi*(2^{1/N}-1)$. The angular spacing $\alpha_j$ of each additional element relative to the first element is defined by $\alpha_j=\alpha_{j-1}*2^{1/N}$, where j varies from 2 to N. Without spacial correlation among elements of the array, sidelobes are diminished, allowing nulls to be placed upon selected co-channel interferers.

22 Claims, 2 Drawing Sheets

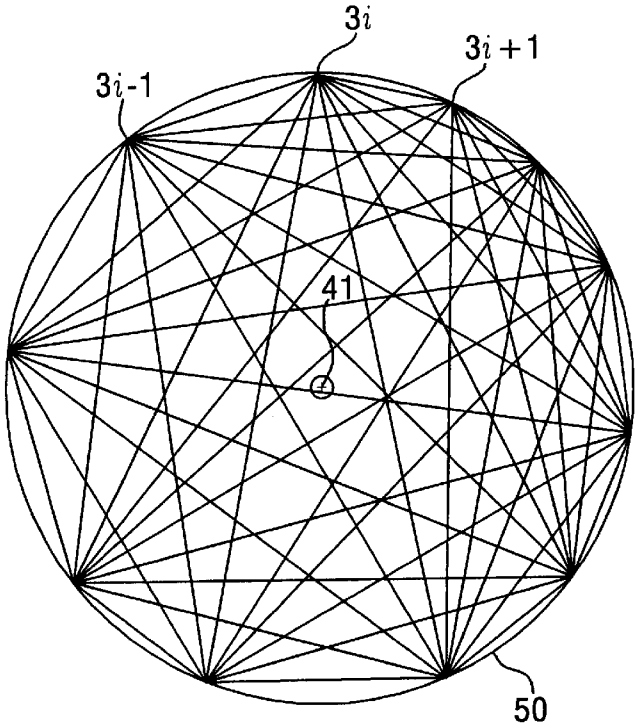
FIG. 5
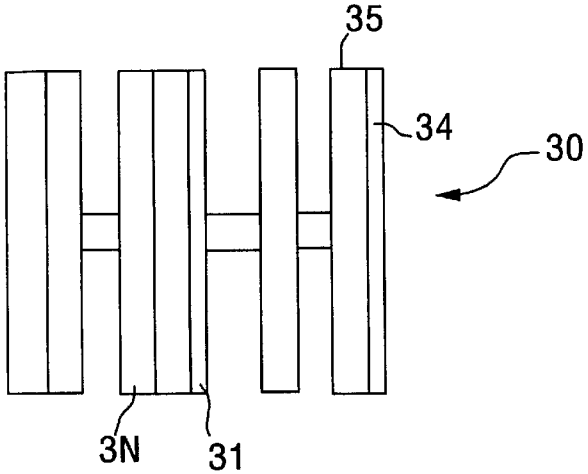
FIG. 3
| Angle | Degrees |
|---|---|
| α1 | 23.4147922 |
| α2 | 24.9377158 |
| α3 | 26.559692 |
| α4 | 28.2871633 |
| α5 | 30.1269912 |
| α6 | 32.0864835 |
| α7 | 34.1734234 |
| α8 | 36.3961001 |
| α9 | 38.7633421 |
| α10 | 41.2845521 |
| α11 | 43.9697443 |
FIG. 4

CIRCULAR PHASED ARRAY ANTENNA HAVING NON-UNIFORM ANGULAR SEPARATIONS BETWEEN SUCCESSIVELY ADJACENT ELEMENTS

CROSS-REFERENCE TO RELATED APPLICATIONS

The present invention relates to subject matter disclosed in the following patent applications, filed coincidently herewith: Ser. No. 09/081,287 (hereinafter referred to as the '287 application), by K. Halford et al, entitled: "Selective Modification of Antenna Directivity Pattern to Adaptively Cancel Co-channel Interference in TDMA Cellular Communication System," and Ser. No. 09/081,460 (hereinafter referred to as the '460 application), by P. Martin et al, entitled: "Bootstrapped, Piecewise-Optimum Directivity Control Mechanism for Setting Weighting Coefficients of Phased Array Antenna," each of which is assigned to the assignee of the present application and the disclosures of which are incorporated herein.

FIELD OF THE INVENTION

The present invention relates in general to communication systems, and is particularly directed to a new and improved phased array antenna arrangement for forming a narrowband beam and/or the accurate placement of nulls, while minimizing sidelobes in the array's directivity pattern. Such improved functionality makes the invention particularly useful as a base station antenna in a time division multiple access (TDMA) cellular communication system, where it is necessary to cancel interference from co-channel users in cells adjacent to the base station.

BACKGROUND OF THE INVENTION

As described in the above-referenced '287 application, in a TDMA cellular communication system, a simplified illustration of which is diagrammatically shown in FIG. 1, communications between a base station BS and a desired user 11-1 in a centroid cell 11 are subject to potential interference by co-channel transmissions from users in cells dispersed relative to cell 11, particularly immediately adjacent cells, shown at 21–71. This potential for co-channel interference is due to the fact that the same frequency is assigned to multiple system users, who transmit during respectively different time slots.

In the non-limiting simplified example of FIG. 1, where each cell has a time division reuse allocation of three (a given channel is subdivided into three user time slots), preventing interference with communications between user 11-1 and its base station BS from each co-channel user in the surrounding cells 21–71 appears to be an ominous task—ostensibly requiring the placement of eighteen nulls in the directivity pattern of the antenna employed by the centroid cell's base station BS.

In accordance with the invention disclosed in the '287 application, this problem is remedied by determining times of occurrence of synchronization patterns of monitored co-channel transmissions from users in the adjacent cells, and using this timing information to periodically update a set of amplitude and phase weights used to control the directivity pattern of a phased array antenna. The array's antenna weights are updated as participants in the pool of interferers change (in a time division multiplexed manner), so as to maintain the desired user effectively free from co-channel interference sourced from any of the adjacent cells.

Since the maximum number of nulls than can be placed in the directivity pattern of a phased array antenna is only one less than the number of elements of the array, the fact that the number of TDMA co-channel interferers who may be transmitting at any given instant is a small fraction of the total number of potential co-channel interferers (e.g., six versus eighteen in the above example) allows the hardware complexity and cost of the base station's antenna to be considerably reduced. However, because the locations of co-channel interferers and therefore the placement of nulls is dynamic and spatially variable, the antenna directivity pattern must be controlled very accurately; in particular, excessive sidelobes that are created by grating effects customarily inherent in a phased array having a spatially periodic geometry must be avoided.

SUMMARY OF THE INVENTION

In accordance with the present invention, this unwanted sidelobe/grating effect problem is minimized by a spatially aperiodic phased array geometry, in which the elements of the array are arranged in a prescribed two-dimensional geometrical distribution, that is effective to decorrelate angular and linear separations among elements of the array. As a consequence, for any radial direction passing through an element of the array (e.g., the angle of incidence of a received signal), the vector distance from any point along that radial direction to any two elements of the array is unequal and uniformly distributed in phase (modulo $2\pi$).

Namely, in the decorrelated antenna element separation scheme according to the invention, no two pairs of successively adjacent antenna elements will have the same angular or chord separation therebetween. Without such spacial correlation among any of the elements of the array, sidelobes of individual elements, rather than constructively reinforcing one another into unwanted composite sidelobes of substantial magnitude, will be diminished, thereby allowing nulls of substantial depth to be placed upon selected co-channel interferers.

For this purpose, the phased array antenna of the present invention comprises a planar circular array of antenna elements (e.g., dipoles) that are unequally spaced apart from one another. The number of elements is based upon array gain and the required independent degrees of freedom (e.g., necessary to null all simultaneously transmitting potential interferers, as described above). Preferably, the diameter of the array is at least an order of magnitude greater than the wavelength of the carrier center frequency of interest.

In order to make the vector distance to any two elements of the array unequal and uniformly distributed in phase for any angle of incidence, the angular separation between successively adjacent antenna elements, as one proceeds around the array, varies in accordance with an Nth root of two, wherein N is the number of antenna elements in the array. To locate each of the N elements of the array, a first element is placed at any arbitrary location along the circumference of the array.

The angular spacing $\alpha_1$ of a second element relative to the first element is defined such that $\alpha_1=2\pi*(2^{1/N}-1)$. The angular spacing $\alpha_j$ of each additional element relative to the first element is defined by $\alpha_j=\alpha_{j-1}*2^{1/N}$, where j varies from 2 to N. The resulting array will have unequal angular spacings among the successively adjacent elements of the array. Moreover, these unequal angular spacings yield corresponding unequal chord separations among all of the elements of the array.

BRIEF DESCRIPTION OF THE DRAWINGS

FIGS. 2 and 3 are respective diagrammatic plan and side views of an embodiment of the spatially decorrelated antenna array according to the present invention;

FIG. 4 tabulates unequal angular spacings among elements of an aperiodic antenna array, using a spatially decorrelating root of two relationship; and FIG. 5 is a chord diagram for an eleven element array whose angular spacings are tabulated in FIG. 4.

DETAILED DESCRIPTION

Figure 1:
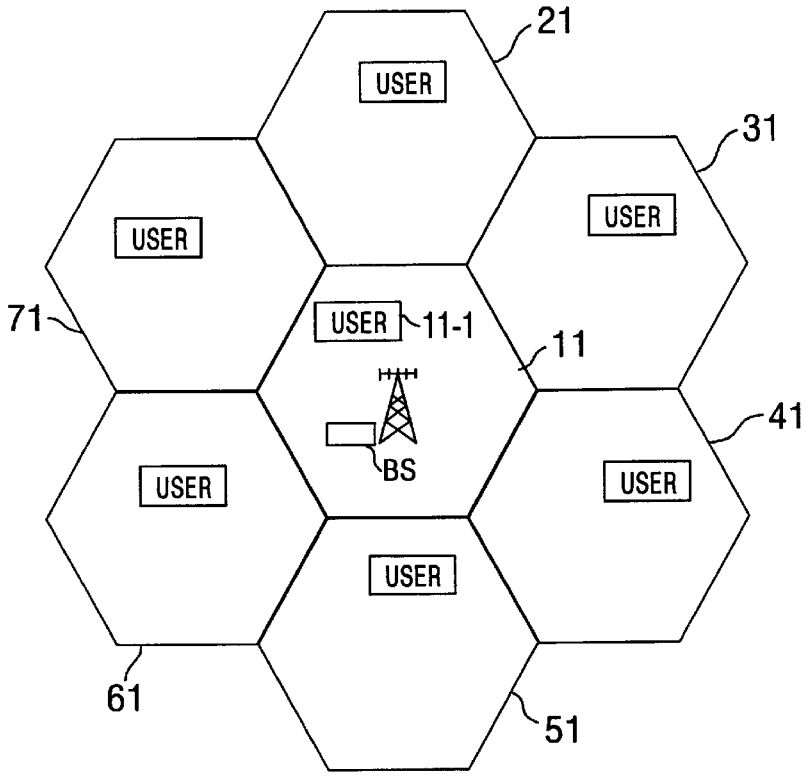
FIG. 1 is a simplified diagrammatic illustration of the cell distribution of a time division multiple access (TDMA) cellular communication system.
Figure 2:
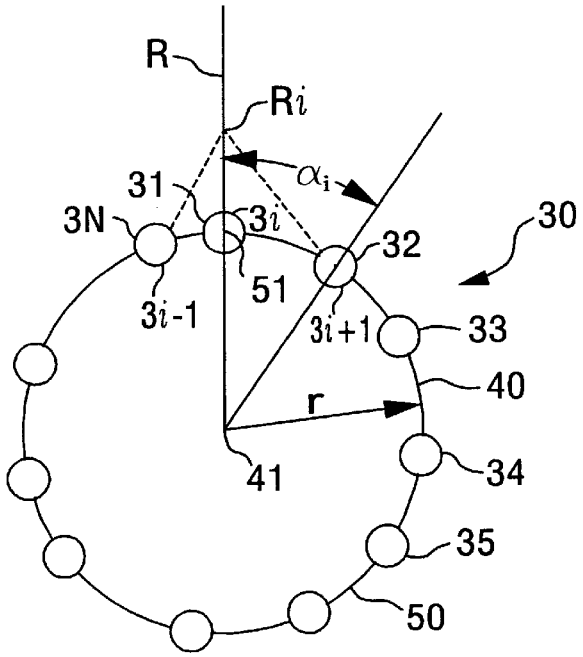

An embodiment of the phased array antenna architecture according to the present invention is diagrammatically illustrated in the plan and side views of FIGS. 2 and 3, respectively, as comprising a plurality of N antenna elements (such as dipole elements) 31, 32, 33, . . . , 3N, that are unequally distributed or spaced apart from one another in a two-dimensional, generally planar array 30, shown as lying along a circle 40 having a center 41. While the non-limiting example illustrated in FIGS. 2 and 3 is that of a circle and shows N=11 elements, it should be understood that the invention is not limited to only a circular shape. Other non-linear array configurations, such as that of an ellipse, for example may be used. Also the invention is not limited to any particular number of elements. For example, when employed in an adaptive directivity control scheme for a six-cell TDMA system of the type described in the above-referenced '287 application, N may equal seven (one more than the number of (six) adjacent cells containing potential co-channel interferers).

Each dipole 3i of the circular array is oriented orthogonal to the plane of the array, so as to produce a directivity pattern that is generally parallel to the plane of the array. Via control of amplitude and phase weighting elements coupled in the feed for each dipole element, the composite directivity pattern of the array is controllably definable to place a main lobe on a desired user, and one or more nulls along (N−1) radial lines 'r' emanating from the center 41 of the array toward adjacent cells containing potential interfering co-channel users. Preferably, the diameter of the array is at least an order of magnitude (e.g., ten to fifteen times) greater than the wavelength of the carrier center frequency of interest.

As described previously, in accordance with the invention, the unequal angular spacing $\alpha_i$ between successively adjacent antenna elements is defined by a prescribed relationship that is effective to decorrelate both angular and linear separations among all of the elements of the array. As a result, for any radial line 'R' intersecting an arbitrary element 3i of the array 30, the vector distance from any point Ri along that radial direction to any two of the elements of the array, such as elements 3(i−1) and elements 3(i+1) as non-limiting examples, is unequal and uniformly distributed in phase (modulo 2π). For this purpose, the angular spacing $\alpha_i$ between any two successively adjacent antenna elements along the circumference of the array may vary in accordance with an Nth root of two, wherein N is the total number N of antenna elements in the array.

In particular, to properly locate each of the N (11 in the present example) elements of the array, a single element 31 is first placed at any arbitrary location, such as at location 51, along the circumference 50 of the array circle 40. Once this first element 31 has been located, the angular spacing $\alpha_1$ of a second element 32 relative to the first element 31 is defined in accordance with equation (1) as:

$$\alpha_1=2\pi*(2^{1/N}-1) \quad (1)$$

The placement of each additional element is defined in accordance with equation (2) as:

$$\alpha_j=\alpha_{j-1}*2^{1/N}, \quad (2)$$

where j varies from 2 to N.

For the present example of an N=11 element array shown in FIGS. 2 and 3, equations (1) and (2) produce respective unequal angular spacings (in degrees) among the successively adjacent elements of the array, as tabulated in FIG. 4.

These unequal angular spacings produce corresponding unequal linear or chord separations among elements of the array, as illustrated in the chord diagram of FIG. 5.

Namely, in the decorrelated antenna element separation scheme according to the invention, no two pairs of successively adjacent antenna elements will have the same angular or chord separation therebetween. Without such spacial correlation among any of the elements of the array, sidelobes of individual elements of the array, rather than undesirably constructively reinforcing one another into unwanted parasitic array sidelobes of substantial magnitude, tend to be effectively diminished, thereby minimizing effective parasitic sidelobe contributions to the array's desired composite directivity pattern, and allowing nulls of substantial depth to be placed upon selected co-channel interferers.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein, but intend to cover all such changes and modifications as are obvious to one of ordinary skill in the art.

What is claimed is:

1. An antenna comprising a plurality of antenna elements arranged along a two-dimensional continuous path having a prescribed regular geometrical shape, and wherein no two pairs of successively adjacent antenna elements have the same mutual separation therebetween.

2. An antenna according to claim 1, wherein said antenna elements are oriented orthogonally to said path, so as to provide a directivity pattern parallel to the plane of said path.

3. An antenna according to claim 1, wherein said path comprises a circular path.

4. An antenna according to claim 3, wherein said circular path has a diameter greater than a wavelength of an antenna element.

5. An antenna according to claim 3, wherein said circular path has a diameter at least an order of magnitude greater than a wavelength of an antenna element.

6. An antenna according to claim 5, wherein, for any point on a radial line in the plane of said circular path and passing through an antenna element of said plurality, the vector distance to any two antenna elements is unequal and uniformly distributed modulo 2π.

7. An antenna, comprising a plurality of antenna elements arranged alone a circular path, and wherein the angular separation between any two successive antenna elements is different from the angular separation between any other two successive antenna elements along said circular path.

8. An antenna according to claim 7, wherein the angular separation between successive antenna elements varies in accordance with a prescribed exponential function.

9. An antenna according to claim 8, wherein the angular separation between successive antenna elements varies in accordance with a 1/Nth exponent, wherein N is the number of antenna elements of said plurality.

10. An antenna according to claim 8, wherein the angular separation between successive antenna elements varies in accordance with an Nth root of two, wherein N is the number of antenna elements of said plurality.

11. An antenna according to claim 7, wherein the angular separation between successive antenna elements is such that, for a one element located at any arbitrary location along said circular path, the angular spacing $\alpha_1$ of a second element relative to said first element is defined by $\alpha_1=2\pi*(2^{1/N}-1)$, and wherein the angular spacing $\alpha_j$ of each additional element relative to said first element is defined by $\alpha_j=\alpha_{j-1}*2^{1/N}$, where j varies from 2 to N, and N is the number of elements of said plurality.

12. An antenna comprising a plurality of antenna elements arranged along a circle having a diameter at least an order of magnitude greater than a wavelength of said antenna elements, said antenna elements having a directivity pattern parallel to a plane containing said circle, and wherein the angular separation along said circle between any two successive antenna elements is different from the angular separation between any other two successive antenna elements.

13. An antenna according to claim 12, wherein said antenna elements comprise dipole elements.

14. An antenna according to claim 12, wherein, for any point on a radial line in the plane of said circle and passing through an antenna element of said plurality, the vector distance to any two antenna elements is unequal and uniformly distributed modulo $2\pi$.

15. An antenna according to claim 12, wherein the angular separation between successive antenna elements varies in accordance with an Nth root of two, wherein N is the number of antenna elements of said plurality.

16. A circular plurality according to claim 12, wherein the angular separation between successive antenna elements is such that, for a one element located at any arbitrary location along said circle, the angular spacing $\alpha_1$ of a second element relative to said first element is defined by $\alpha_1=2\pi*(2^{1/N}-1)$, and wherein the angular spacing $\alpha_j$ of each additional element relative to said first element is defined by $\alpha_j=\alpha_{j-1}*2^{1/N}$, where j varies from 2 to N, and N is the number of elements of said plurality.

17. A circular plurality of antenna elements, in which no two pairs of successively adjacent antenna elements have the same mutual angular separation.

18. A circular plurality of antenna elements according to claim 17, wherein said antenna elements are oriented orthogonally to a plane containing said antenna elements, so as to provide a directivity pattern parallel to said plane.

19. A circular plurality of antenna elements according to claim 18, wherein, for any point on a radial line in said plane and passing through an antenna element of said plurality, the vector distance to any two antenna elements is unequal and uniformly distributed modulo $2\pi$.

20. A circular plurality of antenna elements according to claim 17, wherein the angular separation between successive antenna elements varies in accordance with an Nth root of two, wherein N is the number of antenna elements of said circular plurality.

21. A method of configuring an antenna comprising the steps of:

(a) providing a plurality N of antenna elements; and (b) arranging said plurality N of antenna elements in a prescribed unequally spaced circular distribution that is effective to decorrelate angular and linear separations among elements of the plurality, such that, for any radial direction passing through an element of said plurality, the vector distance from any point along that radial direction to any two elements of the plurality is unequal and uniformly distributed in phase, modulo $2\pi$.

22. A method according to claim 21, wherein step (b) comprises locating a first antenna element at an arbitrary location along the circumference of the plurality, locating a second element on the circumference of the plurality such that the angular spacing $\alpha_1$ of said second element relative to said first element is defined by $\alpha_1=2\pi*(2^{1/N}-1)$, and locating each additional antenna element on the circumference of said plurality, such that the angular spacing $\alpha_j$ of each additional element relative to said first element is defined by $\alpha_j=\alpha_{jj-1}*2^{1/N}$, where j varies from 2 to N.

* * * * *